US010245876B2

(12) United States Patent
Sailer et al.

(10) Patent No.: US 10,245,876 B2
(45) Date of Patent: Apr. 2, 2019

(54) SECURITY ELEMENT AND IDENTIFICATION DOCUMENT

(71) Applicants: Gemalto AG, Aarau (CH); Orell Füssli Sicherheitsdruck AG, Zurich (CH)

(72) Inventors: Christian Sailer, Safenwil (CH); Felix Abt, Zurich (CH); Sylvain Chosson, Zurich (CH)

(73) Assignees: Gemalto AG, Aarau (CH); Orell Füssli Sicherheitsdruck AG, Zurich (CH)

( * ) Notice: Subject to any disclaimer, the term of this patent is extended or adjusted under 35 U.S.C. 154(b) by 63 days.

(21) Appl. No.: 15/315,857

(22) PCT Filed: Jun. 5, 2015

(86) PCT No.: PCT/EP2015/062579

§ 371 (c)(1),
(2) Date: Dec. 2, 2016

(87) PCT Pub. No.: WO2015/185724

PCT Pub. Date: Dec. 10, 2015

(65) Prior Publication Data

US 2017/0096026 A1 Apr. 6, 2017

(30) Foreign Application Priority Data

Jun. 6, 2014 (EP) ..... 14171548

(51) Int. Cl.
*B42D 25/24* (2014.01)
*B42D 25/41* (2014.01)
(Continued)

(52) U.S. Cl.
CPC ..... *B42D 25/41* (2014.10); *B42D 25/24* (2014.10); *B42D 25/29* (2014.10); *B42D 25/309* (2014.10);
(Continued)

(58) Field of Classification Search
CPC ..... B42D 25/24; B42D 2033/42
(Continued)

(56) References Cited

U.S. PATENT DOCUMENTS 5,855,989 A 1/1999 Mantegazza
6,089,614 A 7/2000 Howland et al.
(Continued)

FOREIGN PATENT DOCUMENTS

CN 1221684 A 7/1999
CN 1233217 A 10/1999
(Continued)

OTHER PUBLICATIONS

FR-2918311-A1 Translation (Year: 2009).*

*Primary Examiner* — Kyle R Grabowski
(74) *Attorney, Agent, or Firm* — The Webb Law Firm

(57) ABSTRACT

The invention relates to a security element (1) with authentication information (2) for checking the correct combination of two support parts (3, 4, 5), characterized in that the security element (1) comprises at least one first partial element (6) comprising first partial information (7) and a second partial element (8) comprising second partial information (9). The first partial element (6) can be associated with a first support part (3) and the second partial element (8) can be associated with a second support part (4), both partial elements (6, 8) can be moved from a starting position into a checking position in which both partial elements (6, 8) overlap. The first partial information (7) and the second partial information (9) represent the authentication information (2) when in the checking position.

17 Claims, 6 Drawing Sheets

(51) Int. Cl.
*B42D 25/29* (2014.01)
*B42D 25/351* (2014.01)
*B42D 25/435* (2014.01)
*B42D 25/309* (2014.01)

(52) U.S. Cl.
CPC ..... *B42D 25/351* (2014.10); *B42D 25/435* (2014.10); *B42D 2035/36* (2013.01); *B42D 2035/50* (2013.01)

(58) Field of Classification Search
USPC ..... 283/98, 99
See application file for complete search history.

(56) References Cited

U.S. PATENT DOCUMENTS

| | | | | |
|---|---|---|---|---|
| 8,478,080 | B2 * | 7/2013 | Springmann | B42D 25/45 283/73 |
| 2011/0007934 | A1 | 1/2011 | Springmann et al. | |
| 2015/0129780 | A1 * | 5/2015 | Le Loarer | B42D 25/24 283/113 |

FOREIGN PATENT DOCUMENTS

| | | | | |
|---|---|---|---|---|
| CN | 1890681 | A | 1/2007 | |
| CN | 101795870 | A | 8/2010 | |
| CN | 101821106 | A | 9/2010 | |
| CN | 101918224 | A | 12/2010 | |
| EP | 1580025 | A2 | 9/2005 | |
| FR | 2918311 | A1 * | 1/2009 | B42D 25/24 |
| FR | 2918311 | A1 | 1/2009 | |
| JP | 10166710 | A | 6/1998 | |
| JP | 2001293984 | A | 10/2001 | |
| JP | 2006110820 | A | 4/2006 | |
| JP | 2014114051 | A | 6/2014 | |
| WO | 9815418 | A1 | 4/1998 | |
| WO | 9936271 | A1 | 7/1999 | |
| WO | 2005108106 | A1 | 11/2005 | |
| WO | WO-2011015295 | A2 * | 2/2011 | B42D 25/20 |
| WO | 2011022848 | A1 | 3/2011 | |

* cited by examiner

SECURITY ELEMENT AND IDENTIFICATION DOCUMENT

CROSS-REFERENCE TO RELATED APPLICATIONS

This application is the United States national phase of International Application No. PCT/EP2015/062579 filed Jun. 5, 2015, and claims priority to European Patent Application No. 14171548.2 filed Jun. 6, 2014, the disclosures of which are hereby incorporated in their entirety by reference.

TECHNICAL FIELD

The present invention relates to a security element as claimed in the preamble of claim 1 and to an identification document as claimed in claim 13.

PRIOR ART

Identity documents, in particular passports, typically comprise a cover, a plurality of visa pages, and a data page. The visa pages and the data page are combined with the cover to make up a passport and form one unit.

The data page of a passport contains personalized information pertaining to the owner, such as a photograph, name, date of birth etc. WO 2006/079224 discloses one example of such a data page.

In some passport forgeries, the data page is removed from a passport and inserted into another passport. As a result, the visa pages and the cover no longer match the data page.

SUMMARY OF THE INVENTION

Starting from this prior art, it is an object of the invention to provide a security feature which makes possible simple checking of the correct assignment of at least two carrier parts of an element, in particular an identification document, which comprises at least two carrier parts.

This object is achieved by means of the subject matter of claim 1. According thereto, a security element with an authenticity information item for checking the correct combination or assignment of at least two, or two, carrier parts comprises at least one first partial element having a first partial information item and a second partial element having a second partial information item. The first partial element is assignable to a first carrier part, and the second partial element is assignable to a second carrier part. Both partial elements are movable from a starting position into a check position, in which one partial element overlays the other, wherein the first partial information item and the second partial information item in the check position represent said authenticity information item.

In the check position, the authenticity information item is formed by the first partial information item and the second partial information item. It is hereby possible to check in a simple manner whether the assignment of the first carrier part to the second carrier part is correct. If one of the two partial information items is not compatible with the other partial information item, then the information item that is represented is one from which it is perceivable that the information item is not said authenticity information item. This signals to the person checking the correct assignment of the two carrier parts that the two carrier parts do not belong together, which indicates a manipulation. In a development, the security element comprises, in addition to the first partial element and the second partial element, a third partial element having a third partial information item. The third partial element is assignable to a third carrier part and is movable with respect to the first partial element from a starting position into a check position in which the two partial elements, that is to say the first partial element and the third partial element, overlay one another, wherein the first partial information item and the third partial information item in the check position represent a further authenticity information item.

The further authenticity information item which is represented by the first partial information item and the third partial information item differs in terms of appearance preferably from the authenticity information item which is represented by the first partial information item and the second partial information item. However, the two authenticity information items can also be configured to be identical or similar with respect to one another.

The first partial information item and the second partial information item preferably complete the authenticity information item in the check position, and/or the first partial information item and the third partial information item complete the further authenticity information item in the check position. Complete means that the partial information items supplement one another and thus form the authenticity information item. By way of example, the first partial information item forms a first part of the authenticity information item and the second partial information item forms a second part of the authenticity information item, with the sum of the two parts producing the authenticity information item.

Generally speaking, the sum of the two partial information items of the corresponding partial elements produces said authenticity information item.

The authenticity information item can, however, also be represented by the supplementation or covering of regions of the partial information item. It is conceivable, for example, for the one partial information item to cover regions of the other partial information item. In addition, said one partial information item can be provided, in the region of the coverage, with an additional partial information item, which then supplements the other partial information item on the other carrier part.

The first partial element or the first partial information item preferably differs from the second partial element or the second partial information item. Furthermore, the third partial element, if present, or the third partial information item, if present, preferably differs from the first or second partial element. As a result, the partial information items can have any desired configuration. Alternatively, the partial information items or the partial elements can also be configured to be identical with respect to one another.

Said carrier parts to which said partial elements having the partial information items are assigned can be part of the security element. This is the case in particular if the partial elements are fixedly connected to the carrier parts or are even integrated in the carrier parts.

In a first development, the carrier parts are configured separately from one another and are not in connection with one another. The carrier parts to which are in each case assigned a partial element are configured separately from one another. Consequently, the partial elements of the security element are also configured separately from one another. In other words, the security element comprises the first carrier part having the first partial element, the second carrier part having the second partial element, and optionally the third carrier part having the third partial element, with the carrier parts being configured separately from one another.

In a second development, the carrier parts are configured separately from one another and are in connection with each other via a joint. The joint can be mechanical and/or integral. A mechanical joint can be, for example, a seam of a stitching. An integral joint can be, for example, an adhesive location. In a third development, the carrier parts are in connection with each other such that they are in one piece.

The authenticity information item is preferably at least one image and/or at least one alphanumeric character, wherein the first partial information item represents a first part of the at least one image or of the at least one alphanumeric character, and wherein the second partial information item represents a second part of the at least one image or of the at least one alphanumeric character.

The authenticity information item is preferably a graphically representable information item.

The image as the authenticity information item can be, for example, a photograph, a portrait of the owner of an identification document, the outline of a country, a national coat of arms, a national flag, or a graphical information item. The alphanumeric authenticity information item can be, for example, a document number, a registration number, or a code.

The partial information item is preferably provided such that it can be optically differentiated from directly adjacent regions which are part of the partial element. The partial information item is thus optically identifiable by a viewer. The partial information item is preferably provided in the form of an opaque and/or semi-opaque region. This region is then clearly identifiable by the user and forms at least one part of the partial information item.

At least one of the partial elements preferably comprises at least one transparent or translucent region and an opaque and/or a semi-opaque region. In the case of an overlay, the partial information item of another partial element becomes visible through the transparent or translucent region, wherein said authenticity information item can be completed thereby. Consequently, the one partial information item of one partial element becomes visible through the transparent or translucent region of another partial information item.

With particular preference, the transparent or translucent region is provided in the form of a window in the corresponding carrier part, wherein opaque and/or semi-opaque regions representing the one partial information item are provided in the region of the window. The other partial information item is then visible through the transparent or translucent regions through the window, and in this manner the authenticity information item is assembled. Said regions representing the partial information item may preferably be provided by way of a processing means.

The opaque region preferably serves for supplementing the other partial information item, wherein the opaque region provides the partial information item as such, and/or wherein the opaque region is additionally provided within its region with further partial information items, which likewise supplement the other partial information item.

The partial information item in the window can appear as positive or as negative, depending on the viewing direction. Positive and negative could be real positives and negatives, meaning that they are identical to one another as positive and negative. Alternatively, positive and negative can also be non-real positives or negatives, meaning that they are unequal with respect to one another as positive and negative, for example by way of an arrangement of further partial information items in an opaque region.

The first partial information item is present particularly preferably in the form of at least one opaque and/or semi-opaque region in a transparent or translucent window, while the second and, if appropriate, the third partial information item are present in the form of at least one opaque region, which then becomes visible through the transparent or translucent window of the first partial information item. The partial information item can be assembled from multiple regions or merely from one region.

Said processing means is preferably a printer, wherein said at least one region is printed. Alternatively, the processing means can also be a laser, wherein said at least one region can be provided by a laser-activatable additive, which is variable in terms of color by way of processing being carried out with a laser, or wherein said at least one region can be provided by a metal foil or plastics pigments which are locally destroyable by way of processing being carried out with a laser. The latter is also referred to as metal ablation or plastics ablation. However, said regions can also be used by using said processing means in combination with one another.

Said laser-activatable additive is preferably present in the material by way of which the window is provided. Said laser-activatable additive advantageously has the form of plastics pigments present in the window. Said metal foil or the plastics segments for the ablation are preferably likewise part of the window and can extend over the entire window area or over only part thereof.

The authenticity information item is preferably a personalized information item, in particular a portrait or an alphanumerically presentable personalized information item. The authenticity information item can, however, also be an individualized information item, in particular a document number.

The authenticity information item is preferably distributed over the partial elements according to a random scheme. As a consequence, the partial information items have a random form. Alternatively, the authenticity information item is distributed over the partial elements according to a predetermined scheme or pattern.

The partial elements are preferably defined by area, wherein the area of all partial elements are preferably identical.

To the extent that the carrier parts on which the partial elements are arranged are connected to one another, the partial elements are preferably positioned in each case in the same position on the carrier parts.

By way of example, the partial elements are delimited by an external peripheral line, wherein the area delimited by the peripheral line of all partial elements is identical.

In the check position, the partial elements are preferably located one above the other such that they at least partially coincide or entirely coincide.

The first, second and/or third partial information item or the authenticity information item are preferably optically perceivable information items. With particular preference, the partial information items or the authenticity information item are configured such that they are identifiable by the naked eye without using further aids.

Additionally or alternatively, the first, second and/or third partial information item or the authenticity information item can also be configured such that they become identifiable with the use of ultraviolet light or infrared light.

In one development, the first, second and/or third partial information item can be covered by a security print, which preferably has a greater area than the area of said partial regions.

An identification document, in particular a passport, comprises at least one security element in accordance with the above description and at least a first page corresponding to the first carrier part and a second page corresponding to the second carrier part, wherein the first partial element is fixedly assigned to the first page, and wherein the second partial element is fixedly assigned to the second page, and wherein in the case of an overlay of the two pages, in the check position, the first partial information item and the second partial information item in the overlaid region represent said authenticity information item, in particular complete it.

The first page and the second page are in connection with one another via a joint, such as for example a seam.

In one development, the identification document has a third page corresponding to the third carrier part, wherein the third partial element is fixedly assigned to the third page, and wherein in the case of an overlay in the check position of the two pages, the first partial information item and the third partial information item in the overlaid region represent said further authenticity information item, in particular complete it. The third page is in connection with the first and the second page via a joint.

The partial elements are preferably integral components of the respective page, so that the partial elements cannot be removed from the respective page.

With particular preference, the first page is a data page and the second page is a visa page or a cover page of a passport. The data page is typically made of plastics, in particular polycarbonate, while the visa page is made from a security paper.

In the embodiment with the first, second and third partial element for providing the two authenticity information items, the third page which corresponds to the third carrier element is a cover page.

Further embodiments are specified in the dependent claims.

BRIEF DESCRIPTION OF THE DRAWINGS

Preferred embodiments of the invention will be described below with reference to the drawings which merely serve for explanation purposes and are not to be interpreted in a limiting fashion. In the drawings.

DESCRIPTION OF PREFERRED EMBODIMENTS

Figure 1:
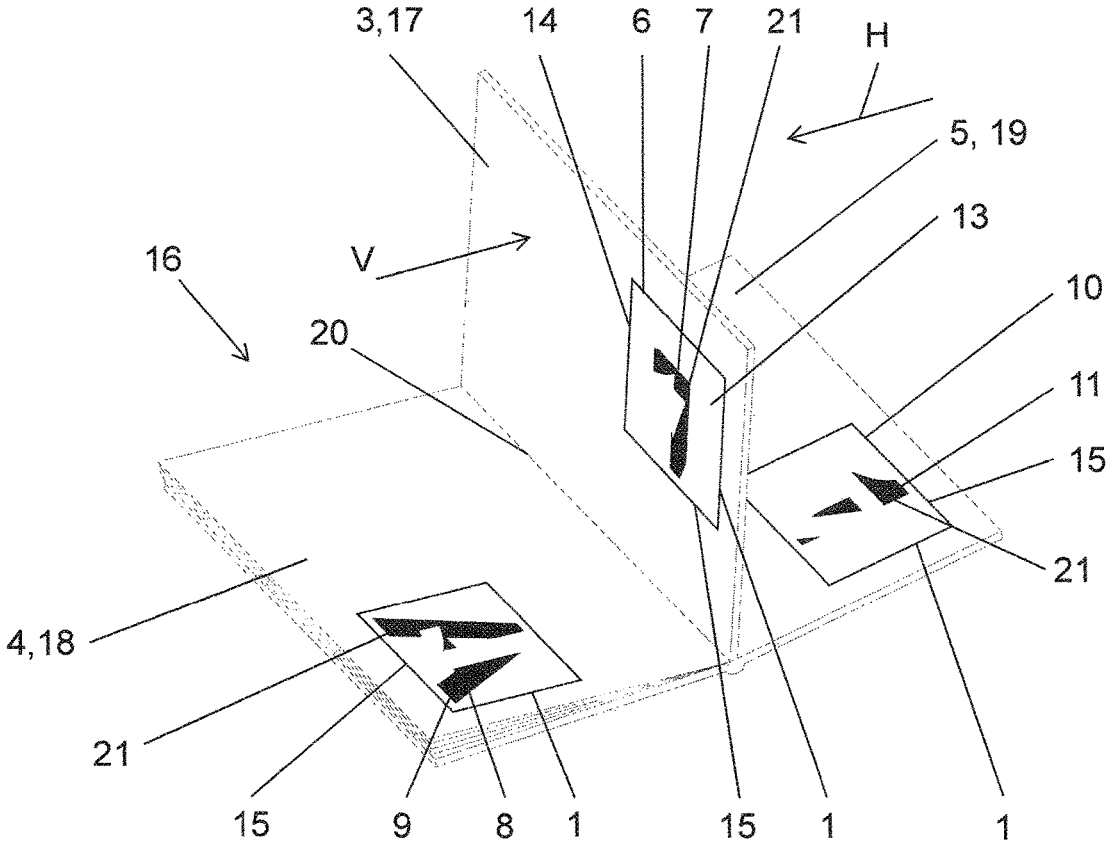
FIG. 1 shows a perspective view of a multi-page document, in particular a passport, having the security element according to the invention.

FIG. 1 shows an identification document 16, in particular a passport, having a security element 1 according to the invention. The identification document 16 will be described below in further detail.

The security element 1 will now be explained in more detail with reference to FIGS. 1 and 2 to 4. The security element 1 comprises an authenticity information item 2 for checking the correct combination or assignment of two, or at least two, in the present case three, carrier parts 3, 4, 5. The authenticity information item signals to the observer whether the carrier parts 3, 4, 5 to be assessed fit together, or whether the carrier parts 3, 4, 5 do not fit together in particular due to non-permissible manipulation, such as a replacement of one of the carrier parts 3, 4, 5.

The security element 1 comprises at least one first partial element 6 having a first partial information item 7 and one second partial element 8 having a second partial information item 9. By way of a relative movement, in particular overlaying, of the first partial element 6 including the first partial information item 7 with respect to/on the second partial element 8 including the second partial information item 8, the authenticity information item 2 is provided.

Figure 3:
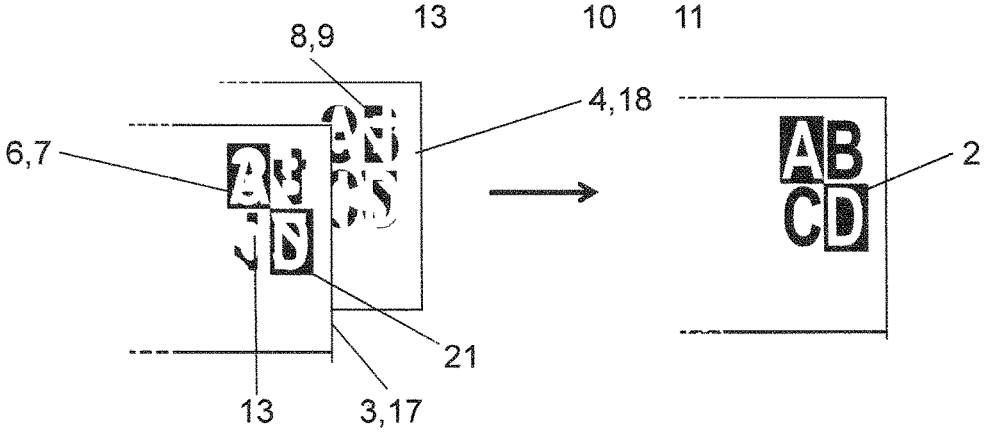
FIG. 3 shows a sequence of the security element according to the invention in the separated and overlaid state.

The first partial element 6 is here assigned to a first carrier part 3, and the second partial element 8 is assigned to a second carrier part 4. The two partial elements 6, 8 are movable relative to one another from a starting position into a check position, wherein starting from the starting position, the two carrier parts 3, 4 are moved toward one another. In FIG. 3, on the left, the carrier parts 3, 4 are shown in the starting position. In FIG. 3 on the right, the carrier parts 3, 4 and consequently also the partial elements 6, 8 are shown in the check position. The partial elements 6, 8 are overlaid in the check position, and the first partial information item 7 and the second partial information item 9 correspondingly represent said authenticity information item 2 in the check position. The authenticity information item in the example of FIG. 3 comprises the letters A, B, C, D, which are arranged within a rectangle. From FIG. 3, it can easily be seen that in the starting position, the partial information items 7, 9 by themselves are not perceivable as an information item which expresses something. It is only by combining the first partial information item 7 with the second partial information item 9 that the authenticity information item 2 becomes visible to the observer. If one of the carrier parts 3, 4 has been replaced by a manipulated carrier part having a different partial information item, the authenticity information item would not be represented, because the two partial information items 7, 9 no longer fit together in the case of a manipulation.

Figure 2:
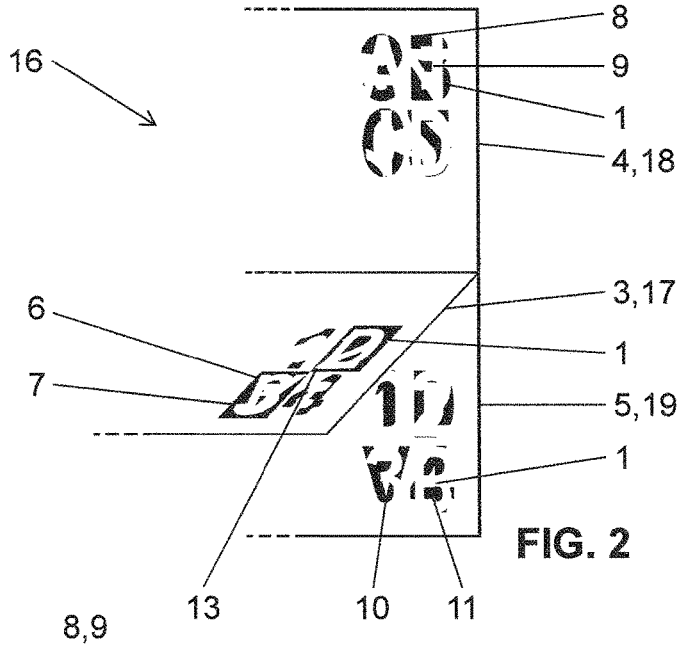
FIG. 2 shows a schematic view of the security element according to the invention on three pages of a multi-page document.
Figure 4:
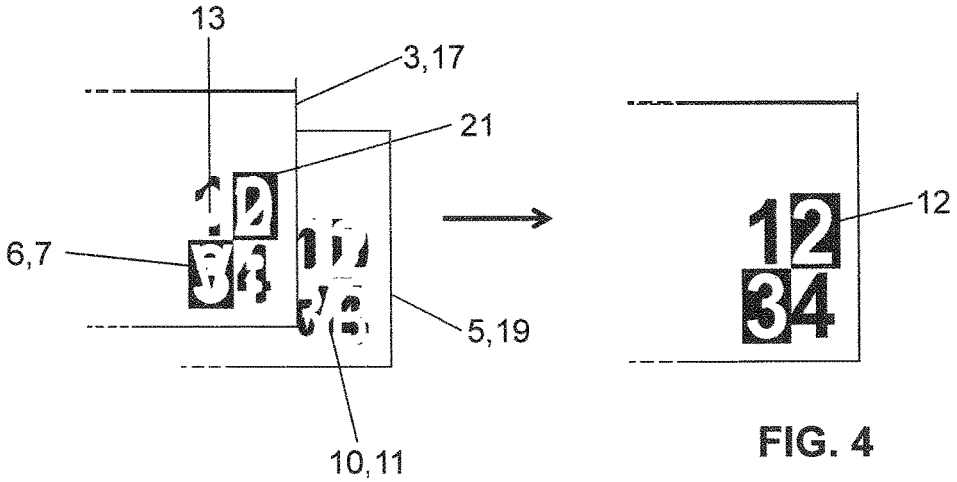
FIG. 4 shows a sequence of the security element according to the invention in the separated and overlaid state.

In the embodiment shown in FIGS. 2 to 4, the security element 1 comprises in addition to the first partial element 6 and to the second partial element 8 a third partial element having a third partial information item 11. The third partial element 10 is assigned to a third carrier part 5. The third partial element 10 having the third partial information item 11 is movable with respect to the first partial element 6 having the first partial information item 7 from a starting position into a check position. In the check position, the first partial element 6 and the third partial element are located one on top of the other and overlay one another, wherein the first partial information item 7 and the third partial information item 11 in the check position represent a further authenticity information item 12. The authenticity information item 12 is correspondingly represented in FIG. 4 and shows the numbers 1, 2, 3, 4.

It can easily be seen with respect to FIGS. 2 to 4 that the first partial information item of the first partial element 6 is identical for the combination with the second partial information item 9 and for the combination with the third partial information item 11. It is thus possible using this one partial information item in combination with the second partial information item 9 and the third partial information item 11 to represent a plurality of, in particular differing from one another, authenticity information items 2, 12.

The representation of the authenticity information item 2, 12 is achieved substantially by completing the respective partial information item 7, 9, 11 with the other partial information item 7, 9, 11. The first partial information item 7 and the second partial information item 9 complete thereby the image such that the authenticity information item 2 is provided, while the first partial information item 7 and the third partial information item 11 complete the image such that the further authenticity information item 12 is represented. This is substantially a sum formation of two information item parts which then leads to the representation of the authenticity information item 2, 12. In other words, the two partial information items to be combined supplement one another in each case to form the authenticity information item.

The carrier parts 3, 4, 5 can be configured in a first variant such that they are separate from one another. Separate in this context is understood to mean that the carrier parts 3, 4, 5 are not physically in connection with each other, but are two parts formed separately from one another. A separate configuration could be used, for example, when adding a package insert to a medicament container. The patient or the medical personnel could then check whether the package insert belongs to the medicament container.

In a second variant, the carrier parts 3, 4, 5 can be configured to be separate from one another, wherein the carrier parts 3, 4, 5 are in connection with each other via a joint. The joint can have various configurations. In a first development according to the second variant, the carrier parts 3, 4, 5 are in contact with one another via a mechanical, preferably non-integral, joint. Such a connection is, for example, a connection as is common in the printing of books, in particular the printing of passports. By way of example, the carrier parts 3, 4, 5 are connected to one another by a stitching using a thread. The carrier parts 3, 4, 5 are indeed configured such that they are separate from one another, but they are in connection with one another via this mechanical connection. In a second development of the second variant, the carrier parts 3, 4, can be in connection with each other via an integral joint, such as an adhesive location. The integral connection can in a development be additionally secured by way of a mechanical connection.

In a third variant, carrier parts 3, 4, 5 can also be in connection with each other such that they form one part. This development has in particular the advantage that increased security against forgeries is provided and manipulation of a one-part document can be easily identified.

In all variants, the invention has the advantage that a check can be performed using the authenticity information item 2, 12 regarding the replacement of one of the carrier parts 3, 4, 5. If one of the carrier parts 3, 4, 5 has been illegally replaced with a different carrier part, a checking person can check this by moving the corresponding carrier parts 3, 4, 5 from the starting position into the check position.

In the embodiment according to FIGS. 2 to 4, the authenticity information item is substantially an alphanumeric character, in the present case a letter and a number. The symbol is here represented as a directly perceivable symbol, see letters B and C and numbers 1 and 4, or indirectly as a symbol which is arranged in a frame, see letters A and D and numbers 2 and 3.

Figure 5:
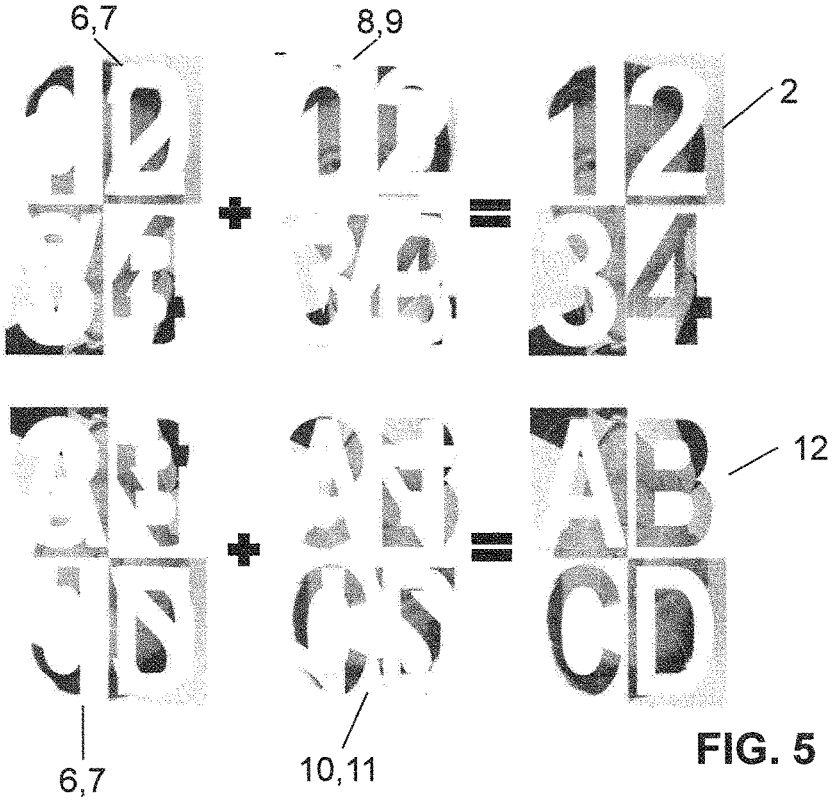
FIG. 5 shows a further embodiment of the security element according to the invention in accordance with the present invention in the separated and overlaid state.
Figure 6:
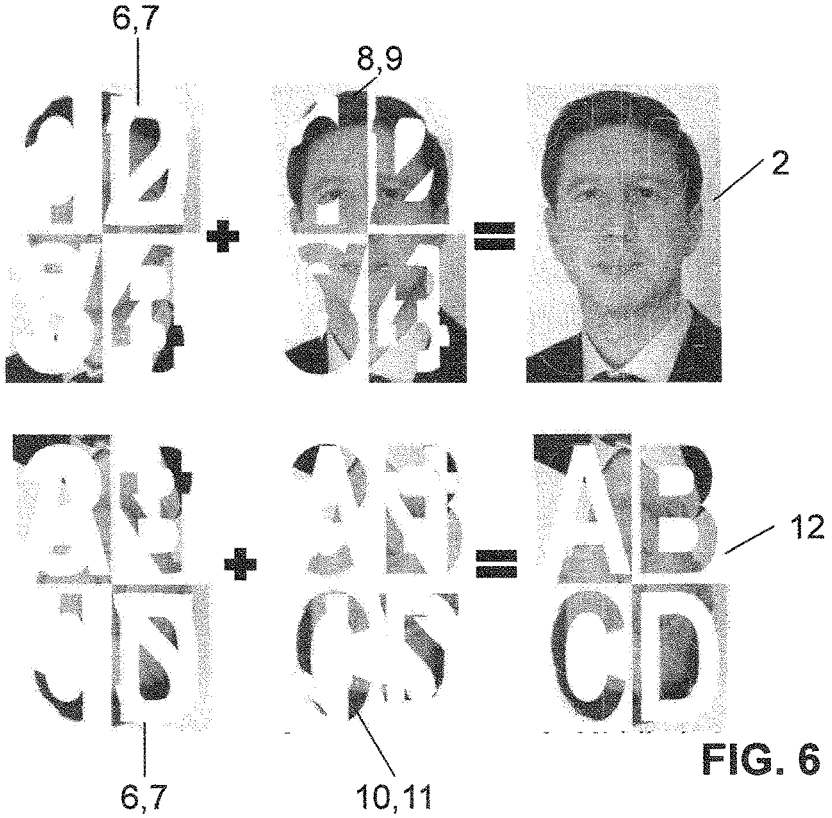
FIG. 6 shows a further embodiment of the security element according to the invention in accordance with the present invention in the separated and overlaid state.
Figure 7:
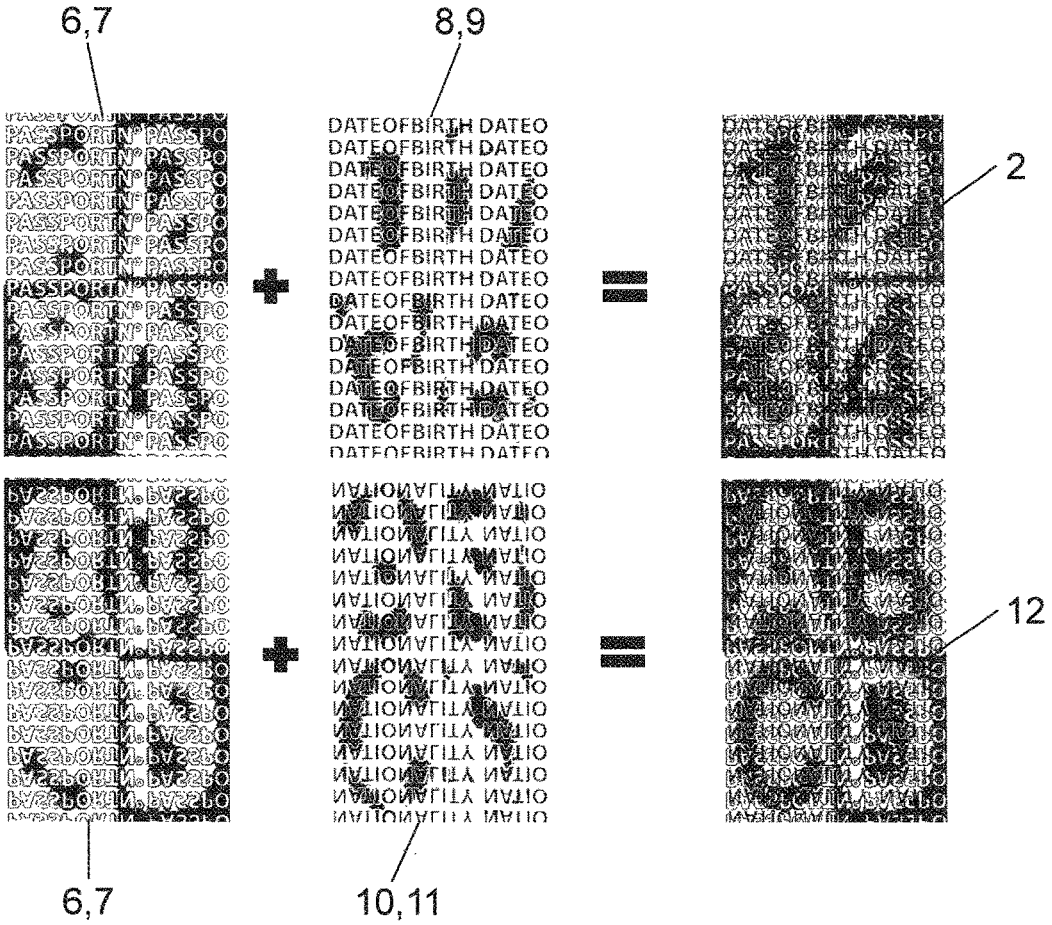
FIG. 7 shows a further embodiment of the security element according to the invention in accordance with the present invention in the separated and overlaid state.

The authenticity information item 2, 12 can also have a different form, as is shown in FIGS. 5 to 7. FIG. 5 shows the combination of an image of a person with alphanumeric characters. In FIG. 6, the authenticity information item 2, 12 has the form of a portrait. In FIG. 7, the authenticity information item 2, 12 has the shape of different alphanumeric characters.

The authenticity information item 2, 12 can thus, as illustrated in the figures, have various configurations. However, with particular preference, the authenticity information item 2, 12 is individualized or personalized. An individualized information item is understood to mean an information item which is assigned to a document. A personalized information item is understood to mean an information item which allows a determination to be made with respect to the owner of the document. The serial number of a document is one example of an individualized authenticity information item 2, 12. A portrait, a date of birth or the place of birth are examples of a personalized authenticity information item.

FIG. 5 shows that the first partial information item 7 represents a first part of the at least one image or of the at least one alphanumeric character. The second partial information item 9, which is shown to the right of the first partial information item 7, represents a second part of the image or of the alphanumeric character. On the far right, the overlay of the first partial information item 7 and the second partial information item 9 is represented. The overlay in the present case is a type of sum formation between the two partial information items 7 and 9. The first partial information item here supplements the second partial information item to form the first authenticity information item 2.

In the further image set in FIG. 5, the combination of the first partial information item 7 with the third partial information item 11 is shown. The first partial information item 7 is here shown on the far left, followed by the third partial information item 11. On the far right, the overlay of the first partial information item 7 with the third partial information item 11 is shown. This overlay forms the further authenticity information item 12. It can be easily seen from FIG. 5 that the first partial information item 7 is identical in both authenticity information items 2, 12. The second and the third partial information items 9, 11 differ from one another, which then results in a different authenticity information item 2, 12.

FIGS. 6 and 7 show configurations which are very similar to FIG. 5, which is why reference is made to the above description.

It can be seen from all embodiments in the figures that the partial information item 7, 9, 11 is provided to be optically variable from immediately adjacent regions, which are also regions of the partial element 6, 8, 10. The partial element 6, 8, 10 thus comprises an optically perceivable partial information item 7, 9, 11. The partial information item 7, 9, 11 is in particular provided in the form of an opaque and/or semi-opaque region in the partial elements 6, 8, 10. The opaque or semi-opaque region carries the reference sign 21. An opaque region is understood to mean a region which is configured such that it is substantially not see-through. A semi-opaque region is understood to mean a region which is somewhat translucent, but not completely transparent. Such a region is optically perceivable.

At least one of the partial elements, in the present case partial element 7, furthermore comprises at least one transparent or translucent region 13, through which the partial information item 9, 11 of the other partial elements 8, 10 becomes visible in the case of an overlay, and an opaque or semi-opaque region 21. Due to the overlay, the authenticity information item 2, 12 thus becomes representable or completable. A transparent region is understood to mean a region which is substantially completely transparent or see-through. A translucent region is understood to be a region which is not completely transparent and is not opaque, with the result that an information item located behind the translucent region can be optically captured through said region.

The transparent or translucent region 13 is preferably provided in the form of a window 14. The window 14 is shown in FIG. 1. The window 14 is here part of the carrier part 3 and is preferably fixedly integrated in the carrier part 3. Opaque and/or semi-opaque regions representing the partial information item 7 are present in the region of the window. The partial information item 7 in FIG. 1 is represented in the window 14 in the form of a black area 7. The regions around the black region 7 are here transparent or translucent, and the observer can see through these regions in the viewing direction V and in the viewing direction H and detect a further information item located therebelow. If the carrier part 3 is folded down in the direction of the second carrier part 4 from the starting position into the check position, the window 14 comes to rest on the second partial information item 9. The user can then identify the second partial information item through the window 14 in the viewing direction H. The second partial information item 9 and the first partial information item 7 here represent said authenticity information item 2, wherein in the present case, the first partial information item 7 completes the second partial information item 9. Equally, folding the first carrier part 3 down to the third carrier part 5 from the starting position into the check position can represent the authenticity information item 12. The viewer can see through the window 14 in the viewing direction V and thereby detects the third partial information item 11. The first partial information item 7 and the third partial information item 11 thereby complete the further authenticity information item 12.

With respect to the viewing directions V and H, it should also be noted that in the viewing direction V, the first partial information item 7 is detectable as positive, and in the viewing direction H the first partial information item is detectable as negative.

The partial information items 7, 9, 11 are provided on the corresponding partial elements 6, 8, 10 by way of a suitable processing means. The processing means can be a printer. The printer is used to print regions or partial regions of said partial information item 7, 9, 11. The processing means can alternatively, or in combination with the printer, be a laser which provides said regions or partial regions by way of a laser-activatable additive which is variable in terms of color through processing being carried out with the laser. In a further embodiment, the processing means can be a laser, wherein said regions or partial regions are provided by way of locally destroying a metal film or plastics pigments by way of the laser. This is metal or plastics ablation. The regions or partial regions which represent the partial information item 7, 9, 11 can also be provided by a combination of the processing means.

With respect to all embodiments it should be noted that the authenticity information item 2, 12 can be distributed randomly over the partial elements 6, 8, 10. That means the partial information item 7, 9, 11 on the partial elements 6, 8, 10 has a random form. The randomness has the advantage that the security against forgeries of such elements is further increased and that a forger cannot pre-produce such security elements. For example, a random generator can be used for the random distribution.

Alternatively, the authenticity information item 2, 12 on the partial elements 6, 8, 10 can also be distributed according to a predetermined scheme, for example according to a predetermined algorithm. That means that the partial information items 7, 9, 11 are distributed and produced according to this predetermined scheme. Such an embodiment has the advantage that the authenticity of the partial information item as such can be checked at a later date.

The partial elements 6, 8, 10 are preferably defined in terms of area. That means that the partial elements 6, 8, 10 have a specific and predefined area. This is shown for example in FIG. 1, where the partial elements 6, 8, 10 are delimited by way of a peripheral line 15. The peripheral line 15 does not absolutely necessarily have to be present, but substantially serves as a border for the determination of the expansion of the partial element 6, 8, 10 on a corresponding carrier part 3, 4, 5. The peripheral line can also be printed. The area of all partial elements 6, 8, 10 is preferably identical. Furthermore, the partial elements 6, 8, 10 are positioned in a document, as is shown for example in FIG. 1, in each case preferably in the same location, with the result that the overlaying in the check position is achievable as easily as possible.

FIG. 1 shows, as explained earlier, an identification document 16. The identification document 16 is preferably a passport. The identification document 16 comprises at least one security element according to the above description and at least one first page 17 corresponding to the first carrier part 3 and a second page 18 corresponding to the second carrier part 4. The first partial element 6 is here fixedly connected to the first page 17 or is an integral part of the first page 17. The second partial element 7 is fixedly connected to the second page 18 or is an integral part of the second page 18. By overlaying the pages 17, 18 in the check position, the first partial information item 7 is located on top of the second partial information item 9, and thus said authenticity information item 2 is represented. The identification document 16 furthermore comprises a third page 19 corresponding to the third carrier part 5. The third page 19 is here arranged opposite the second page 18. That means that the first page 17 can be moved both toward the second page 18 and toward the third page 19. The third partial element 10 is fixedly assigned to the third page 19 and is fixedly connected thereto or is an integral part thereof. In the case of an overlay in the check position of the two pages 17, 19, the first partial information item 7 overlays the third partial information item 11, and said authenticity information item 12 is represented or completed in the overlaid region.

The first page 17 and the second page 18 and, if present, the third page 19 are detachably connected to one another, such as for example via a seam. It is thus theoretically possible for one of the pages to be replaced by a forger. In this case, such a replacement can be easily determined by checking the authenticity information items, and the forgery can thus be easily uncovered.

The first page 17 is preferably a data page of a passport. The data page is typically made of plastics, in particular polycarbonate. A multiplicity of personalized information items are stored on the data page in an optically perceivable and/or electronically readable manner. The second page is preferably a visa page and consists in particular of a security paper. However, individualized and/or personalized information items can also be present on the visa page. The third page can likewise be a visa page or the page of a cover.

FIGS. 8*a* to 8*d* show further examples of partial information items 7, 9, 11, which are then combined to form authenticity information items 2, 12. In principle, reference may be made to the above description, wherein an additional aspect will be explained below with reference to said figures.

Figure 8A:
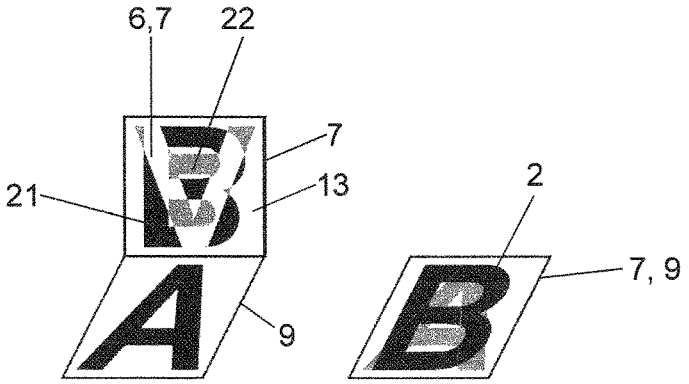
FIGS. 8*a*-8*d* show further embodiments of the security element according to the invention in accordance with the present invention in the separated and overlaid state.

In FIG. 8*a*, the first partial information item 7 has the form of different letters, and the second partial information item 9 has the form of the letter A. The first partial information item 7 comprises transparent regions 13 and opaque regions 21. The opaque regions 21 are additionally provided with further information items within the opaque regions. Said further information items are part of the respective partial information item 7 and carry the reference numeral 22. The opaque regions 21 of the first partial information item 7 in the check position cover parts of the second or third partial information item 9, 11 and complete them with the further information item 22 within the opaque regions 21. This is shown on the far right in the picture in FIG. 8*a*.

Figure 8B:
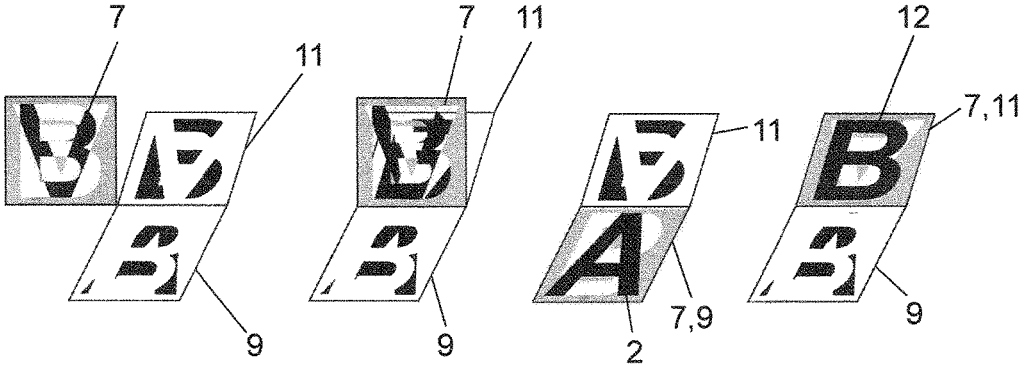
Figure 8C:
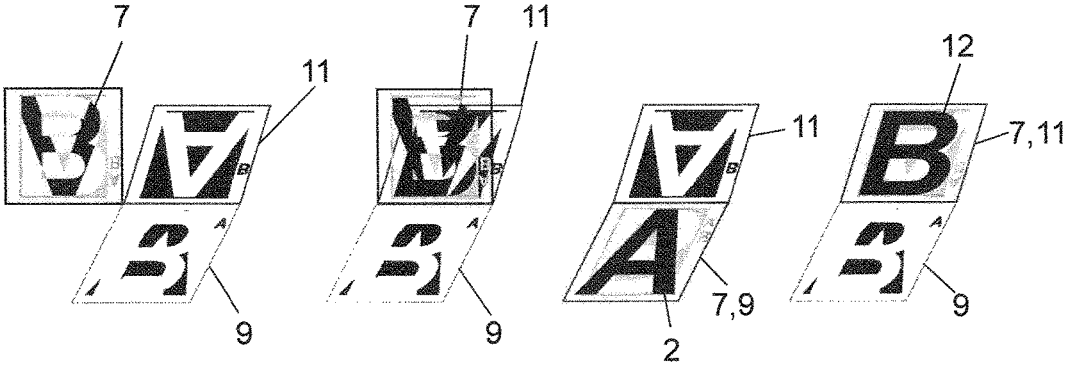

To provide a better understanding, FIGS. 8*b* and 8*c* on the far left show the first partial information item 7 offset with respect to the other two partial information items 9, 11. In the second image from the left, the first partial information item 7 is in the starting position. The first partial information item 7 comprises transparent regions 13 and opaque regions 21. The opaque regions 21 are additionally provided with further information items within the opaque regions. Said further information items are part of the respective partial information item 7 and carry the reference numeral 22. The opaque regions 21 of the first partial information item 7 in the check position cover part of the second or third partial information item 9, 11 and complete them with the further information item 22 within the opaque regions 21. This is shown on the right in both images of FIGS. 8*b* and 8*c*.

Figure 8D:
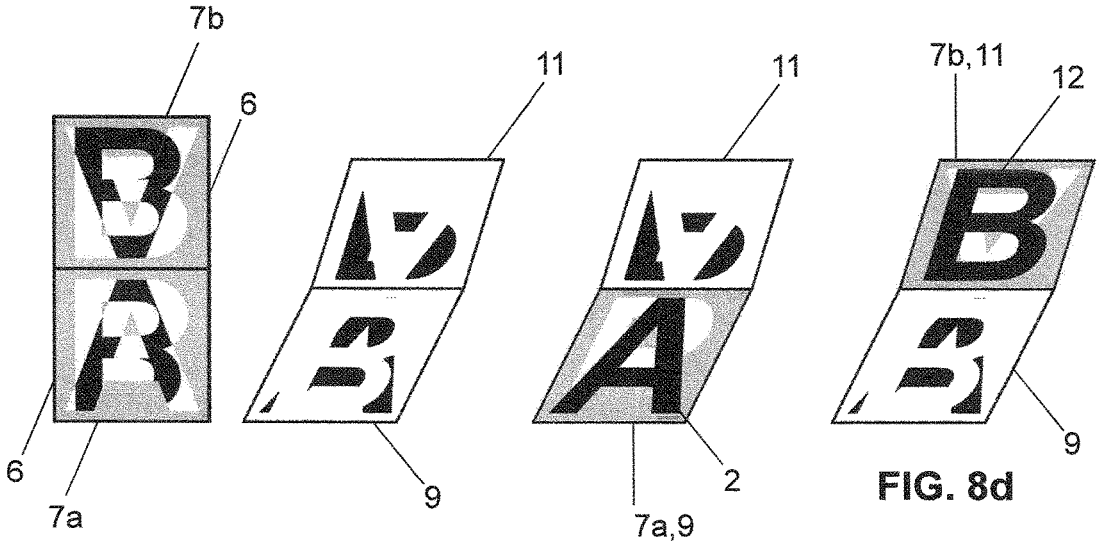

In FIG. 8*d*, in contrast to the examples in FIGS. 8*a* to *c*, the further information item 22 is applied in a manner such that the partial information item takes a different form, depending on the viewing direction toward the partial element 6. In the image of FIG. 8*d*, on the far right, the partial information item 7*a* is produced for the one viewing direction, and the partial information item 7*b* for the other viewing direction. As illustrated in the two right-hand images of FIG. 8*d*, depending on the viewing or combination direction, the result of the second partial information item 9 with the partial information item 7*a* is the authenticity information item 2, and the result of the third partial information item 11 with the partial information item 7*b* is the authenticity information item 12.

LIST OF REFERENCE SIGNS

1 security element
2 authenticity information item
3 first carrier part
4 second carrier part
5 third carrier part
6 first partial element
7 first partial information item
8 second partial element
9 second partial information item
10 third partial element
11 third partial information item
12 authenticity information item
13 transparent or translucent region
14 window
15 peripheral line
16 identification document
17 first page
18 second page
19 third page
20 joint
21 opaque/semi-opaque region

The invention claimed is:

1. A security element having an authenticity information item for checking a correct combination of at least two carrier parts, wherein the security element comprises at least one first partial element having a first partial information item and at least one second partial element having a second partial information item, wherein the first partial element is assignable to a first carrier part and the second partial element is assignable to a second carrier part, wherein the first partial element and the second partial element are movable from a starting position into a check position, in which the first partial element and the second partial element overlay one another, and wherein the first partial information item and the second partial information item in the check position represent said authenticity information item, wherein the security element further comprises at least one third partial element having a third partial information item, wherein the third partial element is assignable to a third carrier part, wherein the third partial element is movable with respect to the first partial element from a starting position into a check position in which the first partial element and the third partial element overlay one another, wherein the first partial information item and the third partial information item in the check position represent a further authenticity information item, wherein the first, second, and third partial elements are at least one of (i) defined by an area, wherein the area of each partial element is identical and (ii) delimited by an external peripheral line running within the corresponding first, second, and third carrier parts, wherein the area delimited by the peripheral line of each partial element is identical, wherein, in the check position, the first, second, and third partial elements are located one above the other such that the first, second, and third partial elements entirely coincide wherein the authenticity information item is at least one of at least one first image and at least one first alphanumeric character, and wherein the first partial information item represents a first part of the at least one of the at least one first image and the at least one first alphanumeric character, and wherein the second partial information item represents a second part of the at least one of the at least one first image and the at least one first alphanumeric character, and wherein the further authenticity information item is at least one of at least one second image and at least one second alphanumeric character, and wherein the first partial information item represents a first part of the at least one of the at least one second image and the at least one second alphanumeric character, and wherein the third partial information item represents a second part of the at least one of the at least one second image and the at least one second alphanumeric character.

2. The security element as claimed in claim 1, wherein the first partial information item and the second partial information item complete the authenticity information item in the check position, and wherein the first partial information item and the third partial information item complete the further authenticity information item in the check position.

3. The security element as claimed in claim 1, wherein the at least two carrier parts are configured separately from one another and are not in connection with one another.

4. The security element as claimed in claim 1, wherein the at least two carrier parts are configured separately from one another and are in contact with each other via a joint.

5. The security element as claimed in claim 1, wherein the at least two carrier parts are in connection with each other such that the at least two carrier parts form one part.

6. The security element as claimed in claim 1, wherein at least one of the first partial information item and the second partial information item is provided such that it is optically distinguishable from directly adjacent regions which are part of the at least one of the first partial element and the second partial element, and wherein the at least one of the first partial information item and the second partial information item is provided in the form of at least one of an opaque and a semi-opaque region.

7. The security element as claimed in claim 1, wherein at least one of the first partial element and the second partial element comprises at least one transparent or translucent region and at least one of an opaque and a semi-opaque region, wherein, in the case of an overlay, the partial information item of another partial element becomes visible through the at least one transparent or translucent region, wherein said authenticity information item is presented or completed thereby.

8. The security element as claimed in claim 7, wherein the at least one transparent or translucent region comprises a window in the corresponding carrier part, wherein the at least one of the at least one opaque and the at least one semi-opaque region comprising the partial information item is provided in the window, and wherein the at least one of the at least one opaque and the at least one semi-opaque region comprising the partial information item is provided by a processing means.

9. The security element as claimed in claim 8, wherein the processing means comprises at least one of:

(i) a printer, wherein the at least one of the at least one opaque and the at least one semi-opaque region comprising the partial information item is printed, (ii) a laser, wherein the at least one of the at least one opaque and the at least one semi-opaque region comprising the partial information item is provided by a laser-activatable additive, which is variable in terms of color by processing with the laser, and (iii) another laser, wherein the at least one of the at least one opaque and the at least one semi-opaque region comprising the partial information item is provided by a metal foil or plastics pigments which are locally destroyable by processing with the another laser.

10. The security element as claimed in claim 1, wherein the authenticity information item is at least one of (i) a personalized information item including at least one of a portrait and an alphanumerically presentable personalized information item and (ii) an individualized information item including a document number.

11. The security element as claimed in claim 1, wherein the authenticity information item is distributed randomly over the first and second partial elements or distributed over the first and second partial elements according to a predetermined scheme.

12. The security element as claimed in claim 1, wherein the authenticity information item formed by the first partial element and the second partial element differs from the authenticity information item formed by the first partial element and the third partial element.

13. An identification document comprising at least one security element as claimed in claim 1, at least a first page corresponding to the first carrier part, and at least one second page corresponding to the second carrier part, wherein the first partial element is fixedly assigned to the first page, and wherein the second partial element is fixedly assigned to the second page, and wherein in the case of an overlay of the first and second pages, in the check position, the first partial information item and the second partial information item in the overlaid region represent said authenticity information item.

14. The identification document as claimed in claim 13, wherein the security element further comprises a third partial element having a third partial information item, wherein the third partial element is assignable to a third carrier part, wherein the third partial element is movable with respect to the first partial element from a starting position into a check position in which the two partial elements overlay one another, wherein the first partial information item and the third partial information item in the check position represent a further authenticity information item, and wherein the identification document further comprises at least one third page corresponding to the third carrier part, wherein the third partial element is fixedly assigned to the third page, and wherein in the case of an overlay in the check position of the first and third pages, the first partial information item and the third partial information item in the overlaid region represent said authenticity information item.

15. The identification document as claimed in claim 14, wherein the identification document comprises a passport, wherein the first page comprises a data page, wherein the second page comprises a visa page, and wherein the third page comprises a cover page.

16. A method for producing the security element as claimed in claim 1, wherein at least one of the first partial information item and the second partial information item is provided by at least one of printing and processing of the carrier element with at least one processing means.

17. A security element having an authenticity information item for checking a correct combination of at least two carrier parts, wherein the security element comprises at least one first partial element having a first partial information item and at least one second partial element having a second partial information item, wherein the first partial element is assignable to a first carrier part and the second partial element is assignable to a second carrier part, wherein the first partial element and the second partial element are movable from a starting position into a check position, in which the first partial element and the second partial element overlay one another, and wherein the first partial information item and the second partial information item in the check position represent said authenticity information item, wherein the security element further comprises at least one third partial element having a third partial information item, wherein the third partial element is assignable to a third carrier part, wherein the third partial element is movable with respect to the first partial element from a starting position into the check position in which the first partial element and the third partial element overlay one another, wherein the first partial information item and the third partial information item in the check position represent a further authenticity information item, wherein the first, second and third partial elements are at least one of (i) defined by an area, wherein the area of each partial element is identical and (ii) delimited by an external peripheral line running within the corresponding first, second and third carrier parts, wherein the area delimited by the peripheral line of each partial element is identical, and wherein in the check position, the first, second and third partial elements are located one above the other such that they entirely coincide, wherein at least one of the first partial element, the second partial element and the third partial element comprises at least one transparent or translucent region and at least one of an opaque and a semi-opaque region, wherein, in the case of an overlay, the partial information item of another partial element becomes visible through the at least one transparent or translucent region, wherein at least one of said authenticity information item and said further authenticity information item is presented or completed thereby, wherein the at least one transparent or translucent region comprises a window in the corresponding carrier part, wherein the at least one of the at least one opaque and the at least one semi-opaque region comprising the partial information item is provided in the window, and wherein the at least one of the a least one opaque and the at least one semi-opaque region comprising the partial information item is provided by a processing means, and wherein the processing means comprises at least one of:

(i) a laser, wherein the at least one of the at least one opaque and the at least one semi-opaque region comprising the partial information item is provided by a laser-activatable additive, which is variable in terms of color by processing with the laser, and (ii) another laser, wherein the at least one of the at least one opaque and the at least one semi-opaque region comprising the partial information item is provided by a metal foil or plastics pigments which are locally destroyable by processing with the another laser.

* * * * *